US005881902A

United States Patent [19]

Ackermann

[11] Patent Number: 5,881,902

[45] Date of Patent: Mar. 16, 1999

[54] MULTILEVEL BAKERY TRAY

[75] Inventor: Jeffrey R. Ackermann, Manhattan Beach, Calif.

[73] Assignee: Rehrig-Pacific Company, Inc., Los Angeles, Calif.

[21] Appl. No.: 893,060

[22] Filed: Jul. 15, 1997

Related U.S. Application Data

[63] Continuation-in-part of Ser. No. 59,414, Sep. 10, 1996, Pat. No. Des. 401,066.

[51] Int. Cl.[6] ..... B65D 21/00

[52] U.S. Cl. ..... 206/509; 206/507

[58] Field of Search ..... 206/509, 511, 206/512, 507; 220/23.83

[56] References Cited

U.S. PATENT DOCUMENTS

| | | | |
|---|---|---|---|
| Re. 26,350 | 2/1968 | Wilson | 220/97 |
| D. 224,366 | 7/1972 | Rehrig | D87/1 |
| D. 247,648 | 3/1978 | Carroll et al. | D87/1 R |
| D. 249,185 | 8/1978 | Carroll et al. | D87/1 R |
| D. 252,961 | 9/1979 | Carroll et al. | D3/67 |
| D. 319,908 | 9/1991 | Stahl | D34/40 |
| D. 348,138 | 6/1994 | Lang-Ree et al. | D3/323 |
| D. 348,344 | 6/1994 | Apps | D3/318 |
| D. 350,028 | 8/1994 | Apps | D3/314 |
| 3,420,402 | 1/1969 | Frater et al. | 220/97 |
| 3,613,943 | 10/1971 | Bridenstine | 220/97 D |
| 3,675,815 | 7/1972 | Rehrig | 220/97 D |
| 3,825,114 | 7/1974 | Johnson et al. | 206/507 |
| 3,865,239 | 2/1975 | Heroizer et al. | 206/507 |
| 3,937,327 | 2/1976 | Carroll | 206/507 |
| 4,000,817 | 1/1977 | Sanders et al. | 206/507 X |
| 4,102,453 | 7/1978 | Carroll et al. | 206/507 |
| 4,106,625 | 8/1978 | Carrol et al. | 206/507 |
| 4,189,052 | 2/1980 | Carroll et al. | 206/507 |
| 4,320,837 | 3/1982 | Carroll et al. | 206/505 |
| 4,379,508 | 4/1983 | Miller et al. | 206/507 |
| 4,423,813 | 1/1984 | Kreeger et al. | 206/506 |
| 4,519,503 | 5/1985 | Wilson | 205/505 |
| 4,523,681 | 6/1985 | Kreeger | 206/507 |
| 4,759,451 | 7/1988 | Apps | 211/126 |
| 4,936,458 | 6/1990 | Tabler et al. | 206/507 |
| 4,960,207 | 10/1990 | Tabler et al. | 206/507 |
| 4,982,844 | 1/1991 | Madan et al. | 206/507 X |
| 5,035,326 | 7/1991 | Stahl | 206/512 X |
| 5,287,966 | 2/1994 | Stahl | 206/509 |
| B1 4,109,791 | 6/1988 | Clipson et al. | 206/506 |

*Primary Examiner*—Steven Pollard
*Attorney, Agent, or Firm*—Banner & Witcoff, Ltd.

[57] ABSTRACT

A multi level bakery tray comprising a generally rectangular bottom, and generally rectangular opposed side and end walls extending upwardly from the bottom. Two pairs of feet are disposed along a lower edge of the end walls while a pair of deep pockets and a pair of shallow pockets are disposed along an upper edge of the end walls. When multiple trays are stacked in a like orientation the shallow pockets receive the feet in a high position. When trays are oriented 180° the deep pockets receive the feet in a low position. Blind stacking and unstacking is accomplished by cooperation between sloped surfaces of the feet and pockets, between the feet and the upper edges of the end walls, and between a drag rail formed beneath the end walls and a shoulder formed on the side walls. Cross nesting is also accomplished by rotating a tray 90° and placing it on a lower tray in a third position lower than the high and low positions.

39 Claims, 10 Drawing Sheets

MULTILEVEL BAKERY TRAY

This application is a continuation-in-part of U.S. application Ser. No. 29/059,614, filed Sep. 10, 1996, now U.S. Pat. No. D. 401,066.

The present invention is directed to a multi level bakery tray, and, more particularly, to a multi level bakery tray which can be stacked in a first, high position in one orientation and in a second, low position when rotated 180°, cross nested in a third lower position when rotated 90°, and can be blind stacked and unstacked in either the high or low positions.

BACKGROUND

Multi level bakery trays which provide the capability of stacking trays at one position in a like orientation, and in a second position when in a 180° orientation, are known in the industry. Stacking trays at multiple heights allows the proper clearance for different products such as bread loaves and buns stored in the trays. It is advantageous for such trays to have the capability of cross nesting when rotated in a 90° orientation to reduce the space required when storing and transporting the trays. Additionally, it is desirable for the trays to be blind stacked and unstacked. Blind stacking refers to the ability to stack a tray on top of a stack of trays, typically when the top of the stack is overhead. The tray to be stacked is generally lifted overhead and the rear of the tray is placed on the front of the stack. The tray is then pushed back along the stack until it is properly positioned on the topmost tray in the stack. Blind unstacking refers to removing the topmost tray from a stack of trays overhead. The front of the desired tray is grasped, lifted slightly, and pulled forward until it is clear of the stack at which point the tray is brought down off of the stack.

Such a multi level bakery tray is disclosed in U.S. Pat. No. 4,960,207 to Tabler et al. The Tabler patent discloses a multi level bakery tray with a pattern of feet along the lower edge of one end wall and corresponding recesses on the upper edge of the same end wall. A different configuration of feet and corresponding recesses are formed on the other end wall. When the trays of Tabler are stacked in a like orientation, the recesses receive the feet such that the trays are stacked in a first, low position. When the trays are in a 180° orientation, the feet and recesses are misaligned and the feet are supported within a channel, providing a second, high position. In this high position, the feet are not positively engaged within recesses as they are in the low position. Blind unstacking the trays of Tabler from the low position can be problematic. As the feet are relatively long and the recesses are relatively deep, it can be difficult to free the feet at the rear of the tray from their corresponding recesses when the front of a tray is lifted in an attempt to remove the tray from the stack. One embodiment of Tabler dealing with the issue of blind unstacking discloses projections extending outwardly from the end walls which engage corresponding slots when the trays are stacked. To blind unstack a tray it is grasped in front and lifted to a point where the projections clear the slots, and then pulled forward slightly. To allow this forward movement, the recesses must be sized larger than the feet that are received therein. The tray is then tilted back to a level position using the projection as a fulcrum about which the tray is rotated. Blind unstacking in this fashion is complex since the handler must raise the tray a sufficient distance for the projections to clear the slots but without any visual or tactile indication as to when this distance has been achieved. The construction of the tray is complex as well in order to facilitate blind unstacking in this manner.

It is an object of the present invention to provide a multi level bakery tray which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of certain preferred embodiments.

SUMMARY

The principles of the invention may be used to advantage to provide a multi level bakery tray having a generally rectangular bottom, and generally rectangular opposed side and end walls extending upwardly from the bottom. Two pairs of feet are disposed along a lower edge of each of the end walls while a pair of deep pockets and a pair of shallow pockets are disposed along an upper edge of each of the end walls.

In accordance with a first aspect, when trays having a like orientation are stacked, the feet are received in the shallow pockets thereby positioning the trays in a first, high position. When one tray is rotated 180° about its vertical axis and stacked on another tray, the feet are received in the deep pockets, thereby positioning the trays in a second, low position.

In accordance with certain preferred embodiments, the trays can be blind stacked and unstacked from the high and low positions. A drag rail extends downwardly from the bottom beneath each end wall. A shoulder is formed on each side wall proximate the ends thereof. When the rear of a tray is placed on a stack of trays, the drag rail is supported by the shoulder of the topmost tray in the stack. As the tray is pushed backwards on the stack, the feet are supported by the upper edge of the end wall until the feet reach their corresponding pockets at which point the feet slide down into and are received by the pockets. To facilitate blind unstacking, cooperating surfaces of the pockets and feet are sloped at substantially the same angle so that as the topmost tray in a stack is lifted by its front edge and pulled forward, the rearmost feet slide upwardly and forwardly out of their respective pockets until the feet reach the upper edges of the end walls at which point the tray can be slid forwardly until is free of the stack. Substantial advantage is achieved by providing a multi level bakery tray having such sloped surfaces as it greatly increases the ease with which trays can be blind stacked and unstacked.

From the foregoing disclosure, it will be readily apparent to those skilled in the art, that is, those who are knowledgeable or experienced in this area of technology, that the present invention provides a significant technological advance. Preferred embodiments of the multi level bakery tray of the present invention can provide smooth and easy blind stacking and unstacking of trays in either the low or high stacked positions, which can reduce expenses incurred in handling and storing trays. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
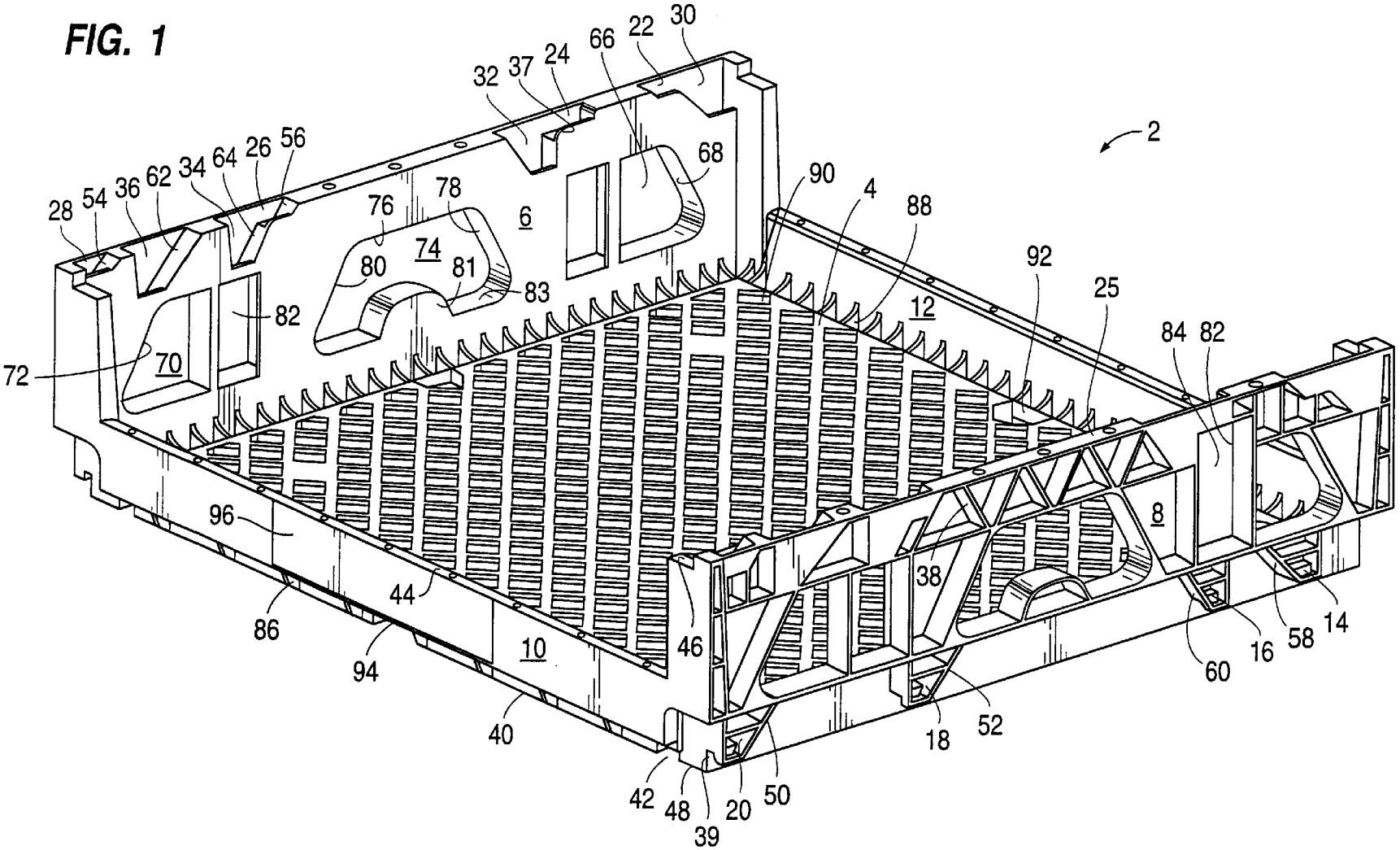
FIG. 1 is a schematic perspective view of a tray of the present invention.

The figures referred to above are not drawn necessarily to scale and should be understood to present a simplified representation of the invention, illustrative of the basic principles involved. Some features of the multi level bakery tray depicted in the drawings have been enlarged or distorted relative to others to facilitate explanation and understanding. The same reference numbers are used in the drawings for similar or identical components and features shown in various alternative embodiments. Multi level bakery trays as disclosed above, will have configurations and components determined, in part, by the intended application and environment in which they are used.

DETAILED DESCRIPTION OF CERTAIN PREFERRED EMBODIMENTS

Multi level bakery trays are often stacked in order to increase the efficiencies of storage. The trays are typically stacked in a like orientation in a first position, rotated 180° to be stacked in a second position, and rotated 90° to be stacked in a cross nested position. The trays can also be blind stacked and unstacked, that is, to be stacked overhead by sliding a tray onto the top of a stack of trays and thereafter removed from the top of the stack. Blind stacking and unstacking requires a tray configuration which allows a tray to easily be placed on top of an existing stack of trays and thereafter removed.

Figure 4:
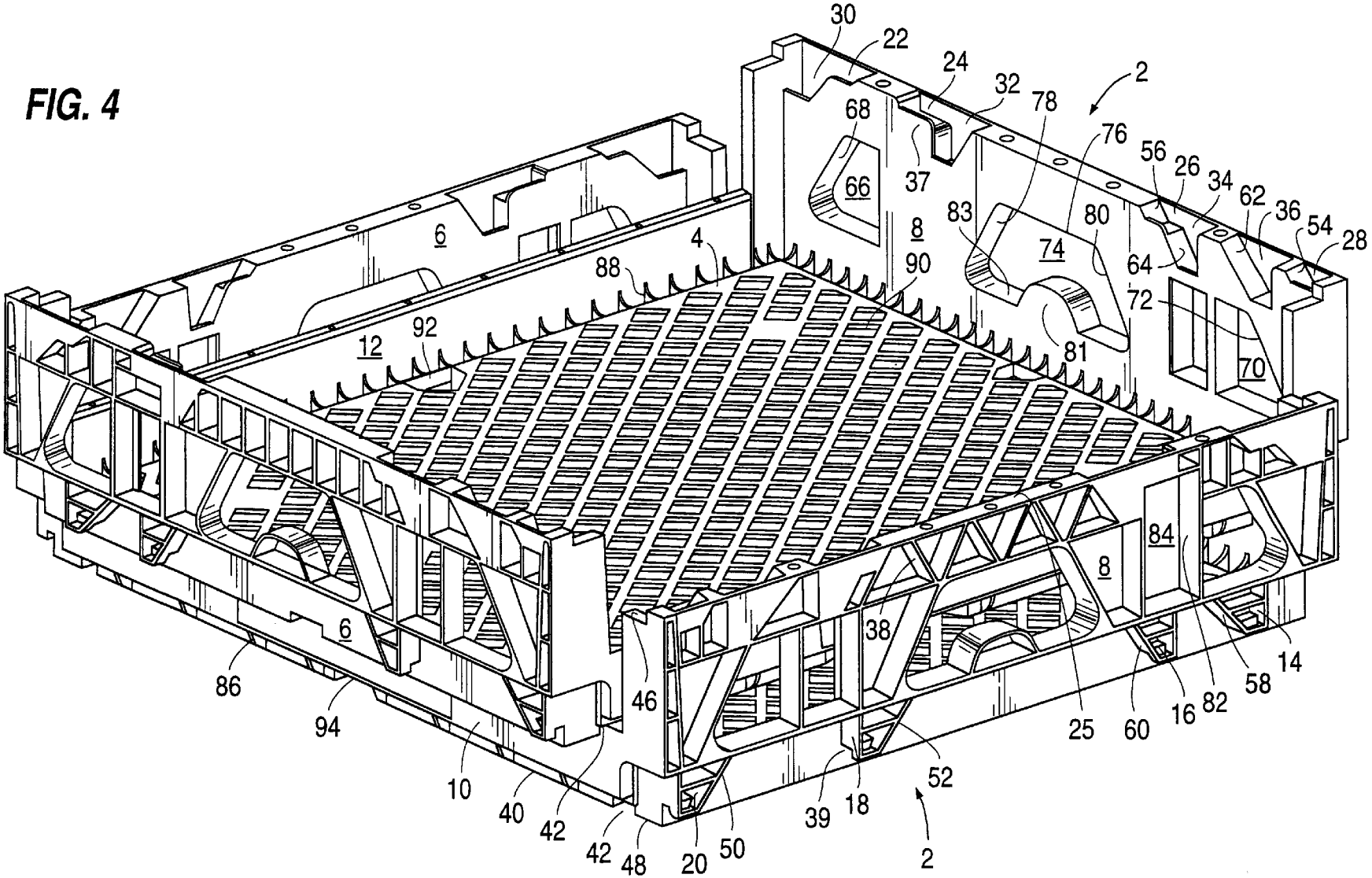
FIG. 4 is a schematic perspective view of a tray of the present invention rotated 90° and cross nested on another like tray.

A preferred embodiment of a multi level bakery tray 2 is shown in FIG. 1. Tray 2 comprises a generally rectangular shaped bottom 4, opposed end walls 6, 8 and opposed side walls 10, 12 extending upwardly from bottom 4. The height of side walls 10, 12 is preferably smaller than the height of end walls 6, 8 such that tray 2 can be rotated 90° and cross nested with another tray, as seen in FIG. 4 and described more fully below.

Unless otherwise stated, or otherwise clear from the context below, directional references used here are based on the orientation of components and assemblies shown in the appended drawings. These directional references assume side wall 12 being the front side of the tray 2, side wall 10 being considered the back side, and end walls 6, 8 being considered the right and left ends respectively.

A front pair of feet 14, 16 and a rear pair of feet 18, 20 are formed along the outside of the end walls 6, 8 proximate the lower edge thereof. A front pair of shallow pockets 22, 24 and a rear pair of shallow pockets 26, 28 are formed along upper edge 25 of end walls 6, 8 to receive the corresponding front feet 14, 16 and rear feet 18, 20, respectively, when the tray is stacked in a first, high position on another tray having a like orientation, as seen in FIG. 3 and described more fully below.

Figure 2:
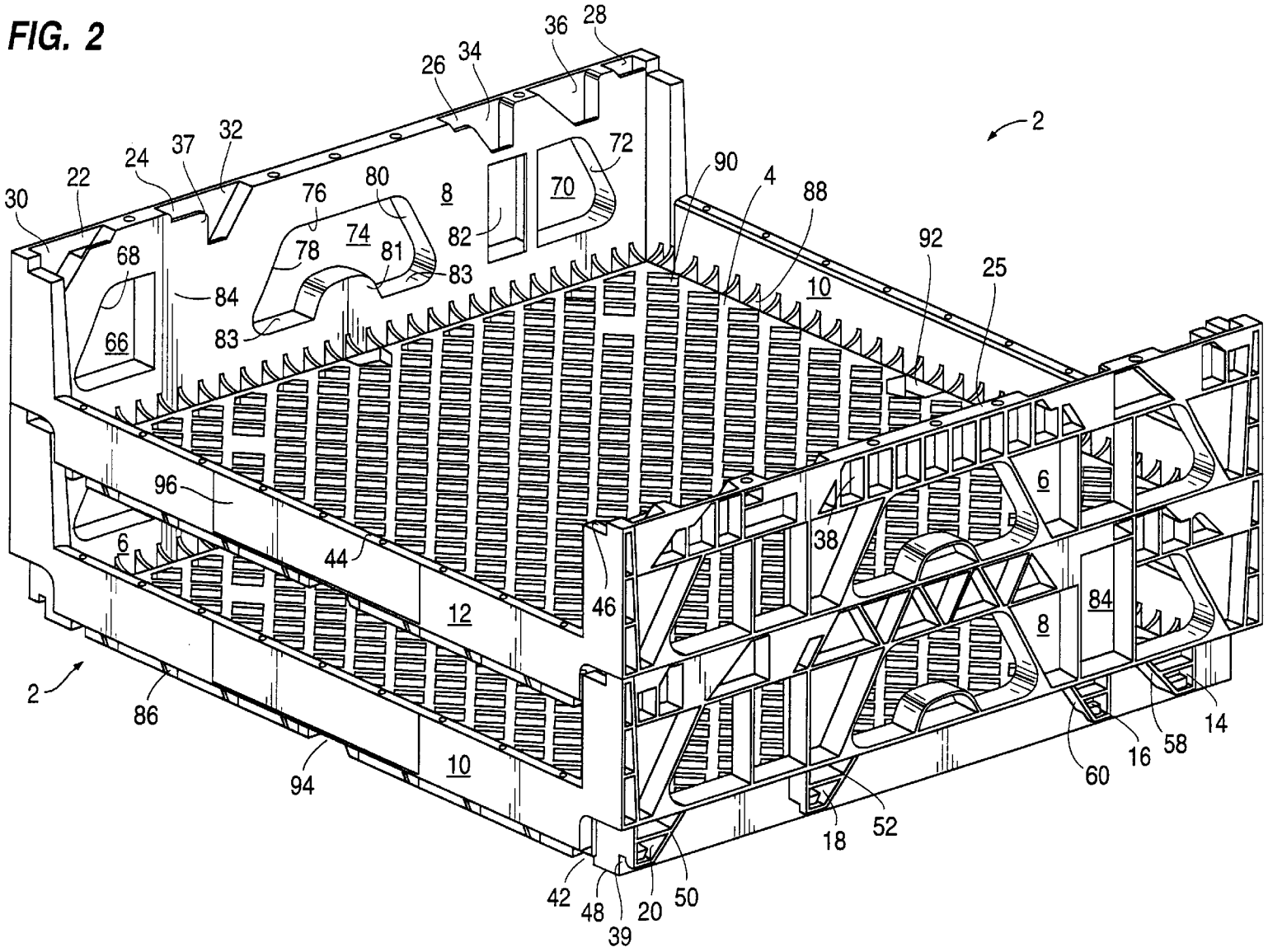
FIG. 2 is a schematic perspective view of a tray of the present invention rotated 180° and stacked on another like tray in a low position.
Figure 6:
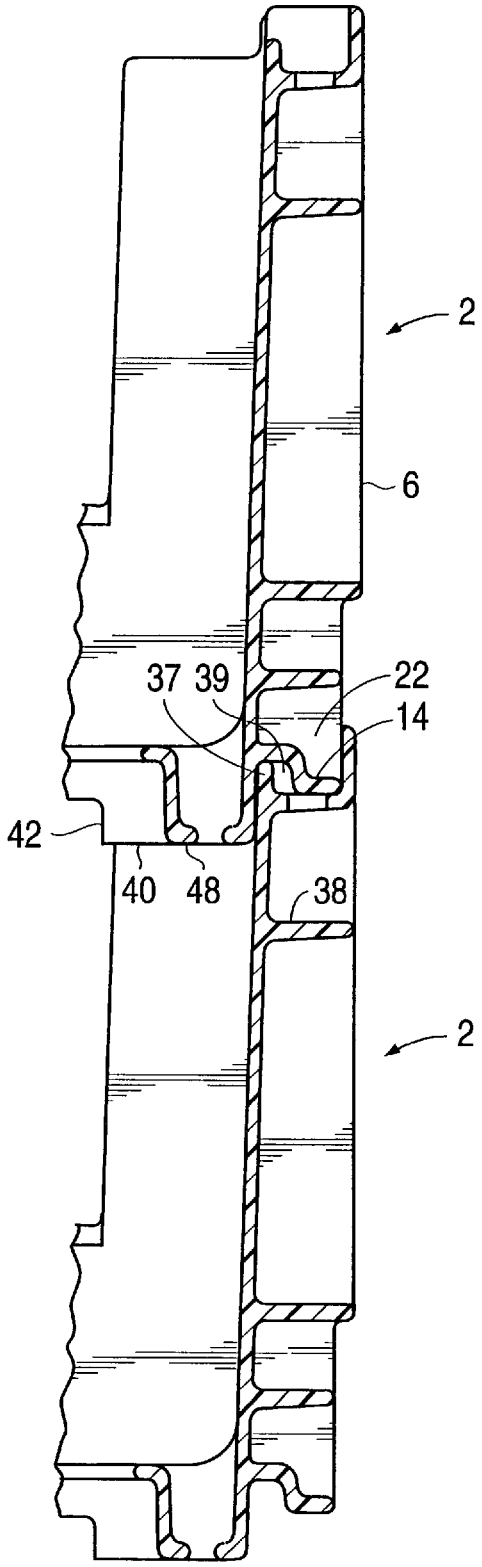
FIG. 6 is a schematic section view, shown partially broken away, illustrating the foot of a tray of the present invention being received within a pocket of another tray upon which the tray is stacked.

A front pair of deep pockets 30, 32 and a rear pair of deep pockets 34, 36 are formed along upper edge 25 of end walls 6, 8 to receive corresponding rear feet 18, 20 and front feet, 14, 16, respectively, when the tray is rotated 180° about its vertical axis and stacked on another tray in a second, low position as seen in FIG. 2. Flanges 37 are formed on the interior surface of each pocket, extending upwardly from the bottom of each pocket and substantially coplanar with the interior surface of the end walls 6, 8 to help contain the feet within the pockets. In a preferred embodiment flanges 37 extend only along a portion of the height of each pocket. Each foot has a recess 39 formed in its lower surface proximate the end wall on which it is formed. Each recess 39 engages a corresponding flange 37 when the feet are received in the pockets to ensure proper alignment of stacked trays as seen in FIG. 6. Reinforcing ribs 38 extend outwardly from the exterior of end walls 6 and 8 to provide rigidity and strength. End wall 6 has a different pattern of reinforcing ribs 38 than end wall 8 which provides a visual confirmation that the trays are oriented 180° with respect to one another. This visual difference provides a quick indicator to a handler which way tray 2 is oriented and can therefore save time. Any time savings realized in handling trays can produce a significant benefit since the number of trays to be handled may reach into the thousands in a large production environment.

In the low stacked position, as seen in FIG. 2, tray 2 is rotated 180° about its vertical axis and placed on another tray 2. Rear feet 18, 20 are received within front deep pockets 32, 30, respectively, and front feet 14, 16 are received within rear deep pockets 36, 34, respectively when two trays 2 are stacked in this manner. The low stacked position allows small items such as buns to be stored in tray 2 while reducing the vertical height needed to store multiple stacked trays.

Figure 3:
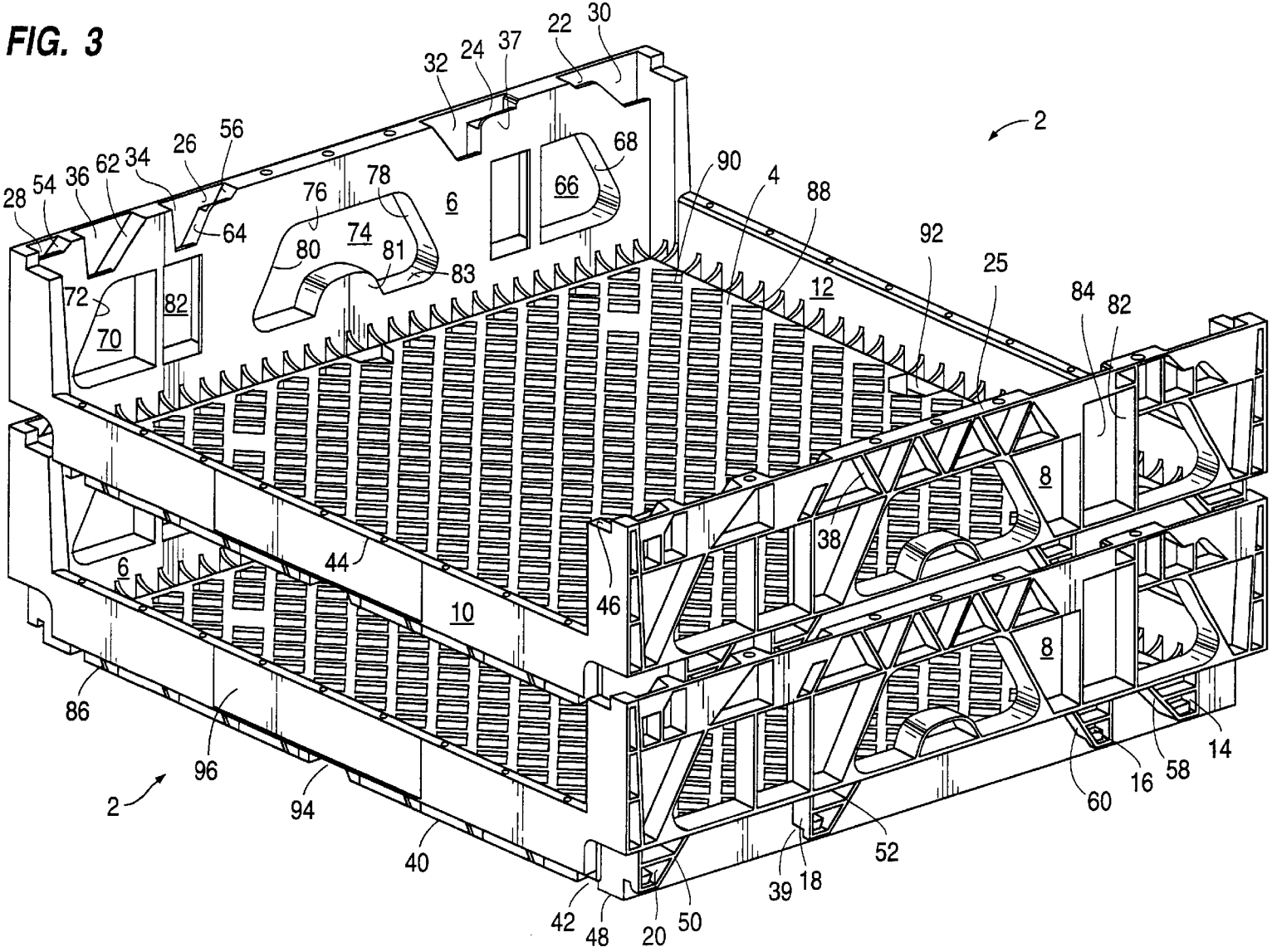
FIG. 3 is a schematic perspective view of a tray of the present invention stacked on another tray, having a like orientation, in a high position.

When trays 2 are stacked in a like orientation, as seen in FIG. 3, front shallow pockets 22, 24 receive front feet 14, 16, respectively, and rear shallow pockets 26, 28 receive rear feet 18, 20, respectively. In this high position the feet are partially exposed, generating a greater space between the trays than when stacked in the low position. This allows larger items such as loaves of bread to be stored in tray 2. When tray 2 is stacked with another tray 2 in a like orientation, the exterior ribs 38 of end walls 8 of the stacked trays 2 have the same pattern, thereby providing visual confirmation of their orientation and efficiencies in handling.

Turning now to FIG. 4, cross nesting of trays 2 will be described in greater detail. Support rails 40 extend downwardly from bottom 4 beneath side walls 10, 12. Recesses 42 are formed along a bottom surface of support rails 40 proximate each end thereof. When a tray 2 is rotated 90° about its vertical axis and then placed on another tray 2, the trays are cross nested in a third, lower, position. When trays are cross nested, recesses 42 of the upper tray 2 engage the upper edges 44 of side walls 10, 12 of the lower tray 2 so as to restrict lateral movement of the stacked trays. In a preferred embodiment, the height of the side walls is such that when two trays 2 are cross nested, a third tray 2 can be rotated 180° about its vertical axis and stacked in the low position on top of the lowermost of the cross nested trays. Trays 2 are stacked in this cross nested manner when they are stored and or transported, which reduces the vertical space needed for stacking, thus saving on storage and handling costs.

Figure 5:
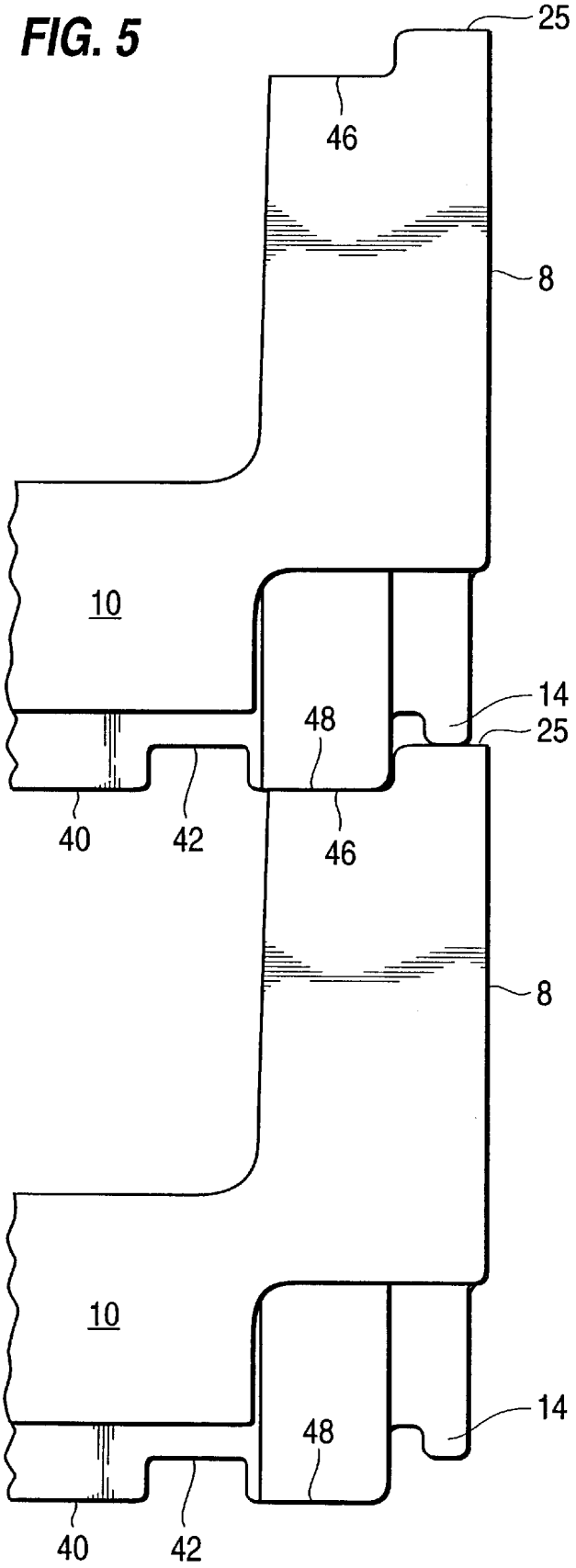
FIG. 5 is a schematic front view, shown partially broken away, illustrating blind stacking of two trays of the present invention.
Figure 7:
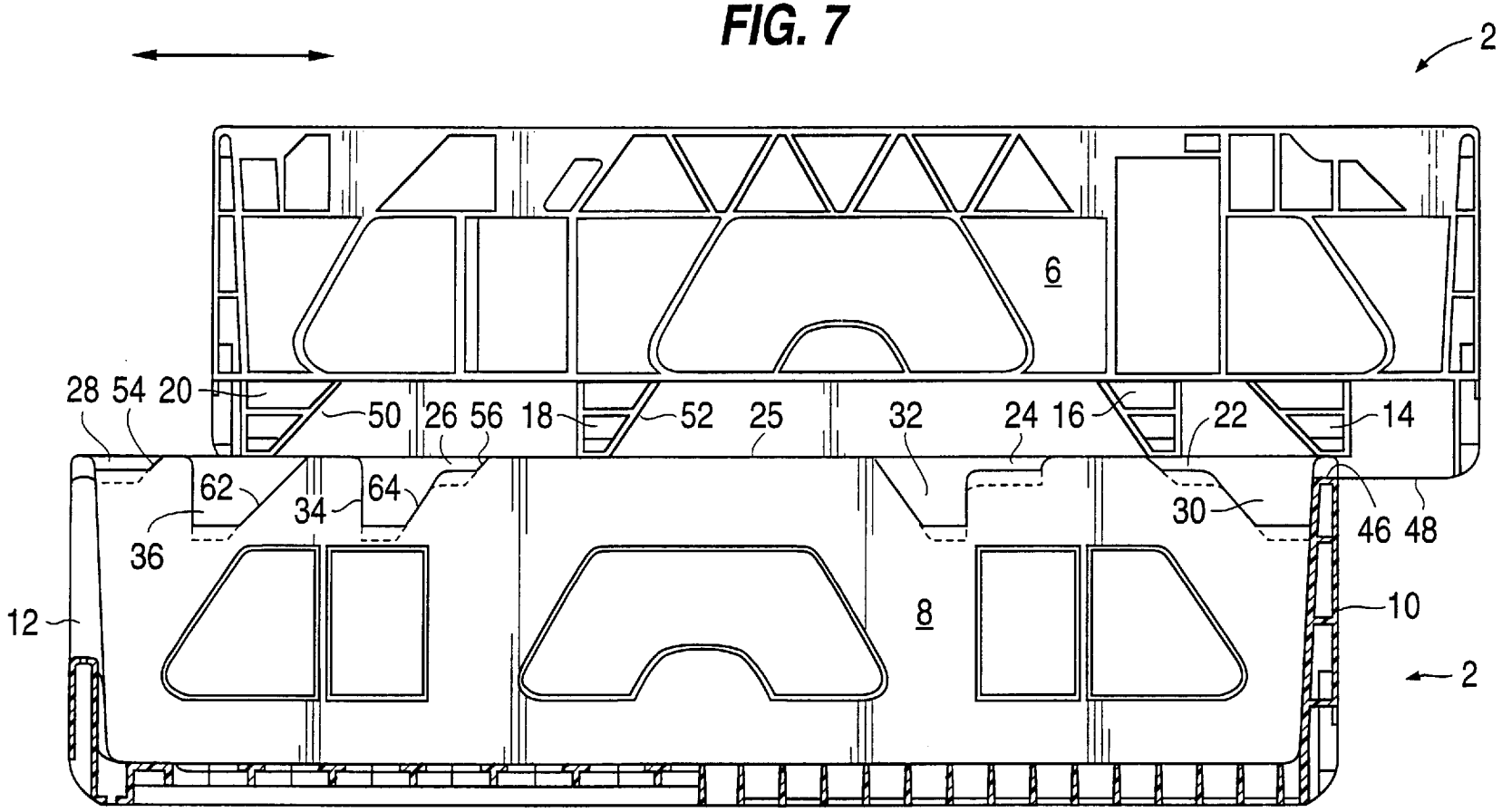
FIG. 7 is a schematic elevation view, shown partially in section, of a tray of the present invention being blind stacked and unstacked on another tray, having a like orientation, into and from a high position.
Figure 8:
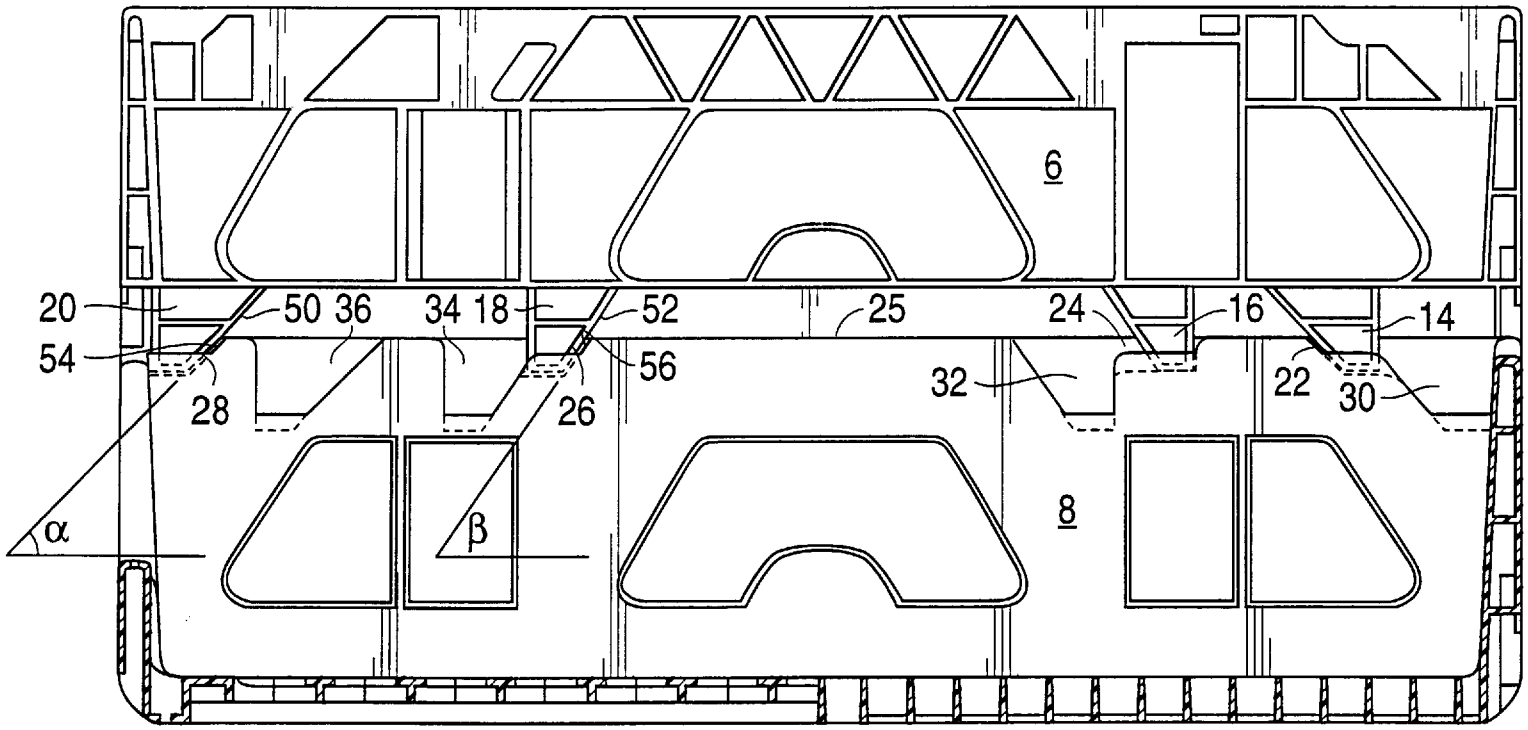
FIG. 8 is a schematic elevation view, shown partially in section, of the trays of FIG. 7 stacked in a high position.

Turning now to FIG. 5, blind stacking will be described in more detail. Blind stacking occurs when a handler is stacking multiple trays, typically over the head of the handler. Since the handler cannot place a tray 2 directly on the top tray in an overhead stack, tray 2 must be constructed to facilitate such stacking. Side walls 10, 12 are provided with support means such as shoulders 46 at outer edges thereof. In a preferred embodiment, shoulders 46 comprise elevated portions of side walls 10, 12. Guide means such as drag rails 48 project downwardly from bottom 4 beneath end walls 6, 8 and extend substantially along the length of end walls 6, 8. Tray 2 is held overhead and the rear of tray 2 is placed on top of the stack of trays 2 (the stack of trays 2 is represented here by a single lower tray 2) such that each drag rail 48 is supported by shoulder 46 of the topmost tray 2 in the stack. As tray 2 is pushed onto the stack, drag rail 48 passes over shoulder 46. As tray 2 continues to be pushed onto the stack, shoulder 46 provides support at the front most edge of the lower tray. As can be more clearly seen in FIG. 7, which shows tray 2 being slid backward to the left onto the top of the stack of trays (depicted here as a single tray 2 shown partially in section so that the interior of end wall 8 is exposed to illustrate the relationship between the feet, the pockets and upper edge 25), the feet 14, 16, 18, 20 slide along and are supported by upper edge 25 of end walls 6, 8. It is important that as the feet pass over the pockets the tray be supported until the feet are positioned over the pocket which is to receive them, especially for the feet passing over the rearmost deep pockets 36, 34 and shallow pocket 26, since the front of tray 2 is generally supported by shoulders 46. This is accomplished by spacing the pockets and feet such that support is provided along upper edge 25 of the lower tray 2 until such time as the appropriate foot is aligned with its respective pocket. As the tray 2 being blind stacked moves over the lower tray 2, the trailing foot 18 of the leading pair of feet (rear feet 18, 20 in this embodiment where the trays are stacked in a like orientation and front feet 14, 16 when trays are stacked in 180° orientation) slides along and is supported by upper edge 25 of the lower tray 2 while the leading foot 20 of the leading pair of feet passes over shallow pocket 26 and deep pockets 34, 36. In a preferred embodiment, front shallow pockets 22, 24 are disposed between front deep pockets 30, 32 while rear deep pockets 34, 36 are disposed between rear shallow pockets 26, 28. Correspondingly, front feet 14, 16 are disposed along end wall 6 such that they align with front shallow pockets 22, 24, respectively, when trays are stacked in the high position as seen in FIG. 8. This arrangement of the feet and pockets therefore ensures that the rear portion of the tray 2 being blind stacked in a high position is supported fully until such time as all of the feet are aligned with their respective pockets.

The feet and pockets are constructed advantageously to facilitate blind unstacking of the trays as well. As seen in FIG. 8, the front surfaces 50, 52 of rear feet 20, 18, respectively, are sloped upwardly from their bottom edges toward the front of tray 2. Similarly front surfaces 54, 56 of rear shallow pockets 28, 26, respectively, are sloped upwardly from their bottom edges toward the front of tray 2 at substantially the same angle as front surfaces 50, 52. When tray 2 is blind unstacked, it is grasped by a user at the front and lifted up slightly such that front foot 16 just clears front shallow pocket 24. As tray 2 is pulled forward, rear feet 18, 20 easily slide upwardly and forwardly out of rear shallow pockets 26, 28 due to the cooperation between the front surfaces 50, 52 of the rear feet 20, 18, and the front surfaces 54, 56 of the rear shallow pockets 28, 26. Once the rear feet are free of the pockets, as seen in FIG. 7, tray 2 can be pulled forward (seen here to the right) to remove it from the stack of trays. The sloped configuration of mating surfaces of the feet and pockets advantageously facilitates blind unstacking since the tray slides naturally upwardly and forwardly along the sloped surfaces. In a preferred embodiment the angle $\alpha$ of the slope of front surfaces 50 and 54, is between about 20° and about 60°, more preferably about 45°, and the angle $\beta$ of the slope of front surfaces 52, 56 is between about 20° and about 60°, more preferably about 55°.

Figure 9:
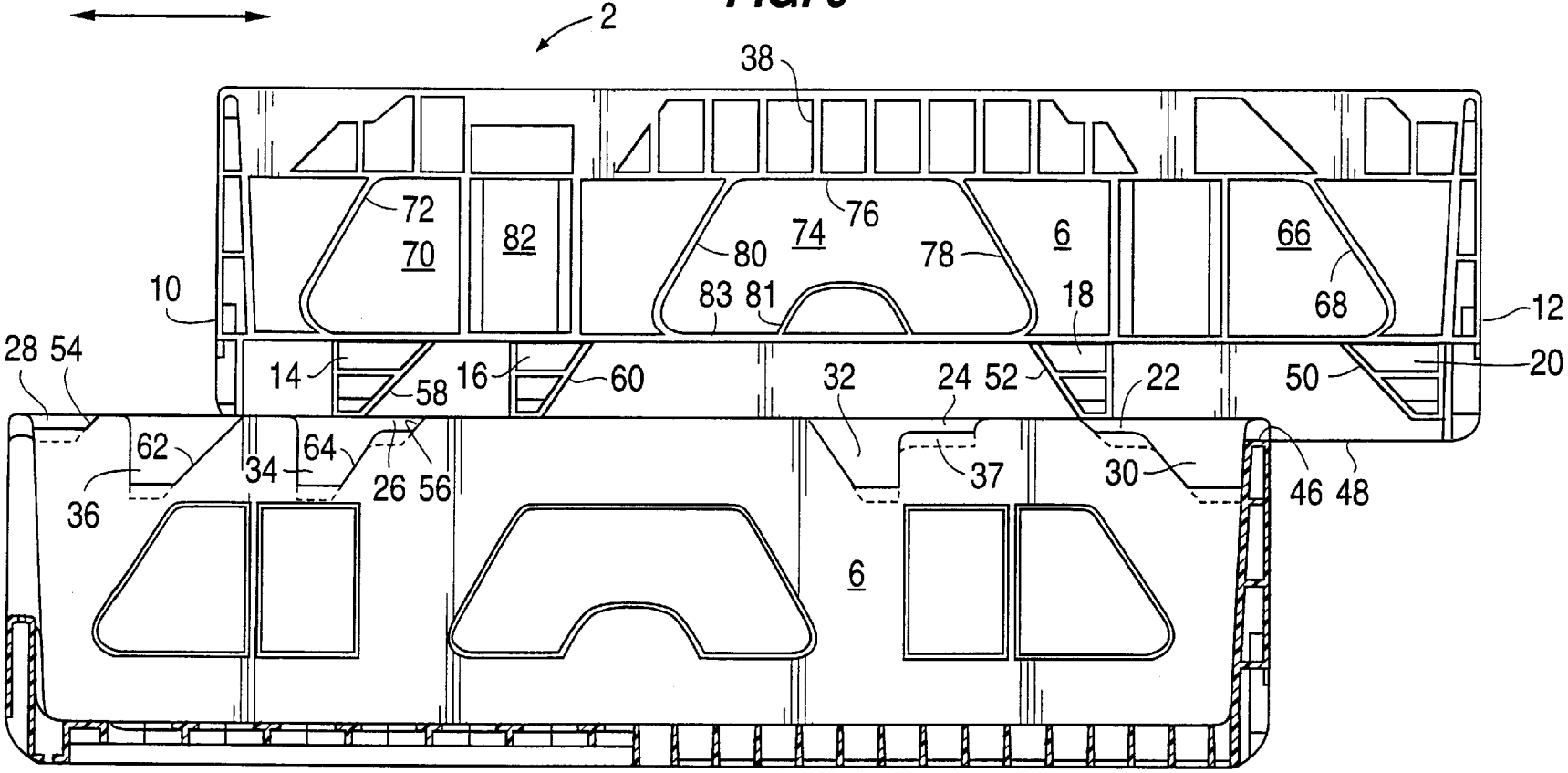
FIG. 9 is a schematic elevation view, shown partially in section, of a tray of the present invention, rotated 180°, being blind stacked and unstacked on another tray into and from a low position.
Figure 10:
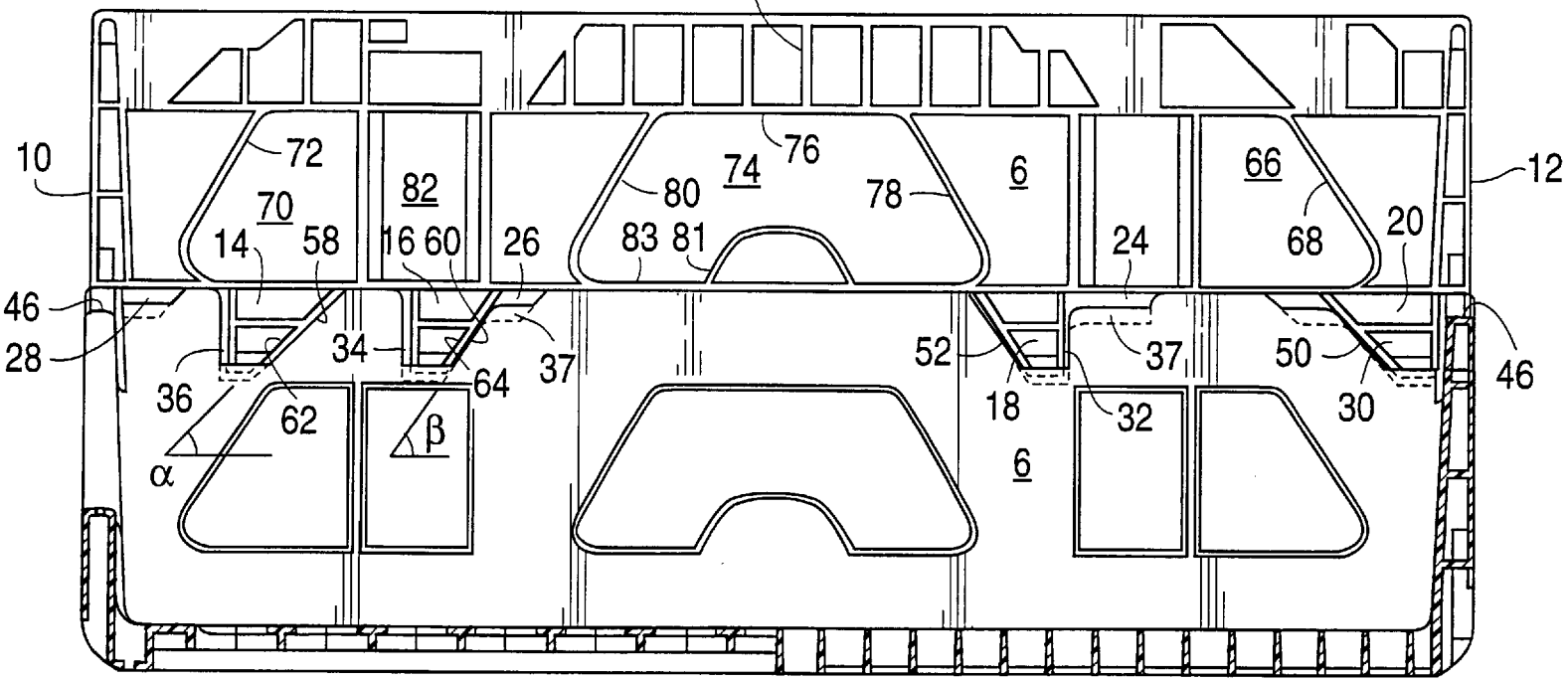
FIG. 10 is a schematic elevation view, shown partially in section, of the trays of FIG. 9 stacked in a low position.

FIG. 9 depicts blind stacking and unstacking in the low position. As above, the lower tray 2 (representing a stack of trays 2) is shown partially in section so as to expose the interior side of end wall 6 and more clearly illustrate the interaction of the feet, the pockets and upper edge 25. As tray 2 being blind stacked moves over lower tray 2, to the left as seen here, trailing foot 16 of the leading pair of feet (seen here as front feet 14, 16 since tray 2 has been rotated 180°) slides along and is supported by upper edge 25 of lower tray 2 while the leading foot 20 of the leading pair of feet passes over shallow pocket 26 and deep pocket 34. When the trays are stacked in the low position, front feet 14, 16 are aligned with and received by rear deep pockets 36, 34, respectively, as seen in FIG. 10.

The rear surfaces 58, 60 of front feet 14, 16, respectively, (the rear of the upper tray 2 is to the right in this figure since the upper tray 2 has been rotated 180°) are sloped upwardly from their bottom edges toward the rear of tray 2 to facilitate blind unstacking. Similarly front surfaces 62, 64 of rear deep pockets 36, 34, respectively, are sloped upwardly from their bottom edges toward the front of lower tray 2 at substantially the same angle as rear surfaces 58, 60. When tray 2 is blind unstacked from the low position, it is grasped by a user at the front and lifted up slightly such that rear feet 18, 20 just clear front deep pockets 32, 30. As tray 2 is pulled forward, front feet 14, 16 easily slide upwardly and forwardly out of the rear deep pockets 36, 34 due to the cooperation between rear surfaces 58, 60 and front surfaces 62, 64. Once all the feet are free of the pockets, as seen in FIG. 9, tray 2 can be pulled forward (shown here to the right) to remove it from the stack of trays. It is to be appreciated that the rear surfaces of front shallow pocket 22 and front deep pockets 30, 32 are sloped upwardly from their bottom edges toward the rear of tray 2 in order to properly receive the feet which each have a sloped surface. In a preferred embodiment the angle $\alpha$ of the slope of front surface 62 of deep pocket 36 and the slope of rear surface 58 of front foot 14 is between about 20° and about 60°, more preferably about 45°, and the angle $\beta$ of the slope of front surface 64 of deep pocket 34 and the slope of rear surface 60 of front foot 16 is between about 20° and about 60°, more preferably about 55°.

In a preferred embodiment front handles 66 are formed in end walls 6, 8 proximate side wall 12 and comprise an aperture framed by exterior ribs 38, as seen in FIG. 1. Handles 66 are generally rectangular with their front surface 68 being sloped upwardly and toward the rear of tray 2. Sloped surface 68 provides a convenient surface for a handler to grasp tray 2, similar to a pistol grip, when blind stacking and unstacking trays in the high position. Similarly rear handles 70 are formed in end walls 6, 8 proximate side wall 10 and comprise an aperture framed by exterior ribs 38. Rear handles 70 are generally rectangular with a rear surface sloping upwardly toward the front of tray 2. Rear handles 70 facilitate blind stacking and unstacking trays when tray 2 is rotated 180° and stacked in the low position in a manner similar to front handles 66. Central handles 74 are formed in end walls 6, 8 in central portions thereof. Central handles 74 have a generally horizontal upper surface 76, a front surface 78 sloping upwardly toward the rear of the tray, and a rear surface 80 sloping upwardly toward the front of the tray. Sloped surfaces 78 and 80 facilitate blind stacking from and to the high and low positions, respectively, while upper surface 76 provides a convenient place to grasp tray 2 when stacking trays at lower heights. Raised portion 81 extends upwardly from lower surface 83 of central handle 74. Raised portion 81 prevents contents of the tray from falling through the aperture formed by central handle 74.

In another preferred embodiment, apertures 82 are formed in end walls 6, 8, with one aperture 82 preferably formed between central handle 74 and front handle 66, and another between central handle 74 and rear handle 70. One of the apertures 82 has a cover 84, shown in FIG. 1 as the front most aperture on end wall 8. Cover 84, in combination with apertures 82 forms an optical indicator, that is, a means by which automated optical handling equipment using lasers or other such optical recognition equipment can determine the orientation of tray 2. The optical recognition device can detect which aperture has a cover and therefore ascertain whether a particular tray 2 is oriented correctly. This feature can improve the automated handling of such trays, thereby reducing costs.

Side walls 10, 12 are preferably formed of double wall construction with ribs 86 extending between and generally perpendicular to the two walls in order to increase the strength of tray 2. Fillets 88 are formed at the intersection of end walls 6, 8 and side walls 10, 12 and spaced therealong to increase the strength of tray 2 as well. Bottom 4 is comprised of a grid pattern with apertures 90 extending therethrough, providing rigidity and strength as well as ventilation and drainage. Access apertures 92 are formed along bottom 4 proximate side walls 10, 12 in central portions thereof. In a preferred embodiment, access apertures 92 are pentagonally shaped apertures. Notches 94 are formed along the lower edges of support rails 40 proximate access apertures 92 such that a hook or any other known device can extend under tray 2 through notch 94 and access aperture 92, and thereby grasp tray 2. This facilitates handling of trays 2 by automated equipment.

In another preferred embodiment, indicator 96 is provided on the exterior surface of either or both of the side walls 10, 12. Indicator 96 may be any type of indicating means such as a company logo, a label indicating "front" or "back", or other means which distinguishes the front from the back of tray 2.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

I claim:

1. A multi level bakery tray comprising in combination:

a generally rectangular bottom;

opposed side walls and opposed end walls extending upwardly from the bottom, the tray being stacked with a like tray in a like orientation in a first position, in a second position when rotated 180° about its vertical axis, and in a third position when rotated 90° about its vertical axis;

a plurality of feet formed along lower edges of each of the end walls;

a plurality of shallow pockets formed along upper edges of each of the end walls to receive the feet of a stacked tray when trays are stacked in the first position;

a plurality of deep pockets formed along upper edges of each of the end walls to receive the feet of a stacked tray when trays are stacked in the second position;

guide means formed on the bottom; and support means formed on the side walls, the support means cooperating with the guide means to provide support for a tray being blind stacked and unstacked with another tray;

wherein a majority of one of a front surface and a rear surface of each of the feet is sloped upwardly toward one of a front and a rear of said tray to facilitate blind stacking and unstacking of the tray with the another tray.

2. A tray in accordance with claim 1 wherein the plurality of shallow pockets comprise a front pair and a rear pair of shallow pockets, the plurality of deep pockets comprise a front pair and a rear pair of deep pockets, and the plurality of feet comprise a front pair and a rear pair of feet.

3. A tray in accordance with claim 2 wherein a trailing foot of a leading pair of feet is supported by an upper edge of each end wall when a leading foot of the leading pair of feet passes over at least one pocket of the rear pair of shallow pockets and the rear pair of deep pockets of another tray as the tray is being blind stacked and unstacked with the other tray.

4. A tray in accordance with claim 2, wherein front surfaces of the rear pair of shallow pockets and front surfaces of the rear pair of feet slope upwardly and toward a front of the tray, the front surfaces of the rear pair of feet sliding along the front surfaces of the rear pair of shallow pockets to facilitate removal of the feet from the shallow pockets when stacked trays are blind unstacked from the first position.

5. A tray in accordance with claim 4 wherein the front surfaces of the rear pair of shallow pockets and the front surfaces of the rear pair of feet are sloped at an angle of between about 20° and about 60°.

6. A tray in accordance with claim 4 wherein the front surface of the rearmost rear shallow pocket and the front surface of the rearmost rear foot are sloped at an angle of about 45°, and the front surface of the frontmost rear shallow pocket and the front surface of the frontmost rear foot are sloped at an angle of about 55°.

7. A tray in accordance with claim 2 wherein the front pair of shallow pockets are disposed between the front pair of deep pockets and the rear pair of deep pockets are disposed between the rear pair of shallow pockets, the front pair of feet of another tray stacked in like orientation on the tray being received by the front shallow pockets and the rear pair of feet of the other tray being received by the rear shallow pockets.

8. A tray in accordance with claim 7 wherein the front pair of feet of the other tray engage the rear pair of deep pockets of the tray and the rear pair of feet of the other tray engage the front pair of deep pockets of the tray when the other tray is oriented 180° and stacked on the tray in the second position.

9. A tray in accordance with claim 2 wherein front surfaces of the rear pair of deep pockets are sloped upwardly toward a front of the tray and rear surfaces of the front pair of feet are sloped upwardly and toward a back of the tray such that the rear surfaces of the front pair of feet slide along the front surfaces of the rear pair of deep pockets when the tray is blind unstacked from the second position on top of another tray to facilitate blind unstacking.

10. A tray in accordance with claim 9 wherein the front surfaces of the rear pair of deep pockets and the rear surfaces of the front pair of feet are sloped at an angle of between about 20° and about 60°.

11. A tray in accordance with claim 9 wherein the front surface of the rearmost rear deep pocket and the rear surface of the frontmost front foot are sloped at an angle of about 45°, and the front surface of the frontmost rear deep pocket and the rear surface of the rearmost front foot are sloped at an angle of about 55°.

12. A tray in accordance with claim 1 further comprising ribs formed on the exterior surfaces of the end walls, the ribs forming a pattern on each end wall distinct from the pattern on the other end wall to provide a visual indication of the orientation of the tray.

13. A tray in accordance with claim 1 wherein a plurality of handles are formed in each end wall.

14. A tray in accordance with claim 13 wherein the handles comprise apertures formed in each end wall, at least one of the handles having at least one of a forwardly and downwardly sloped front surface and a rearwardly and downwardly sloped rear surface to facilitate grasping the handle and blind stacking and unstacking the tray.

15. A tray in accordance with claim 1 further comprising an orientation indicator.

16. A tray in accordance with claim 15 wherein the orientation indicator comprises a pair of apertures formed in each end wall, one of the apertures in one of the end walls having a cover.

17. A tray in accordance with claim 1 wherein the sidewalls have a height lower than the end walls such that the tray cross nests at a third position.

18. A tray in accordance with claim 17 wherein the tray can cross nest between two other trays which are stacked in the second position.

19. A tray in accordance with claim 17 further comprising support rails formed along the front and rear edges of the bottom, the support rails having a notch formed proximate each end, the notches engaging upper edges of the side walls of another tray when the tray is cross nested with the other tray to reduce horizontal displacement of the trays when cross nested.

20. A tray in accordance with claim 1 further comprising a recess formed on a bottom surface of each foot and a flange extending at least partially along an interior surface of each pocket, the recess of each foot engaging the flange of a corresponding pocket when the tray is stacked on another tray in the first and second positions.

21. A tray in accordance with claim 1 wherein the guide means comprise rails formed along the bottom and extending substantially along the length of the end walls; and the support means comprise shoulders formed along outer edges of the side walls to support the rails when the tray is blind stacked and unstacked with another tray.

22. A multi level bakery tray comprising in combination:

a generally rectangular bottom;

opposed side walls and opposed end walls extending upwardly from the bottom, the tray being stacked with a like tray in a like orientation in a first position, in a second position when rotated 180° about its vertical axis, and in a third position when rotated 90° about its vertical axis;

four feet formed along a lower edge of each end wall;

four shallow pockets formed along an upper edge of each end wall to receive the feet of a stacked tray when trays are stacked in a like orientation in the first position;

four deep pockets formed along an upper edge of each end wall to receive the feet of a stacked tray when trays are stacked in a 180° orientation in the second position;

a pair of guide rails formed along the bottom, each guide rail extending substantially along the length of an end wall; and shoulders formed along outer edges of the side walls to support the guide rails when the tray is blind stacked and unstacked with another tray;

wherein a majority of one of a front surface and a rear surface of each of the four feet is sloped upwardly toward one of a front and a rear of said tray to facilitate blind stacking and unstacking of the tray with the another tray.

23. A tray in accordance with claim 22 wherein a trailing foot of a leading pair of feet is supported by an upper edge of each end wall when a leading foot of the leading pair of feet passes over at least one pocket of the rear pair of shallow pockets and the rear pair of deep pockets of another tray as the tray is being blind stacked and unstacked with the other tray.

24. A tray in accordance with claim 22 wherein the pockets comprise a front pair of shallow pockets disposed between a front pair of deep pockets and a rear pair of deep pockets disposed between a rear pair of shallow pockets, the feet being disposed to align with and be received by the shallow pockets when the tray is stacked in like orientation on another tray and to align with and be received by the deep pockets when the tray is stacked in 180° orientation on another tray.

25. A tray in accordance with claim 24, wherein front surfaces of the rear pair of shallow pockets and front surfaces of the rear pair of feet slope upwardly and toward a front of the tray, the front surfaces of the rear pair of feet sliding along the front surfaces of the rear pair of shallow pockets to facilitate removal of the feet from the shallow pockets when stacked trays are blind unstacked from the first position.

26. A tray in accordance with claim 25 wherein the front surfaces of the rear pair of shallow pockets and the front surfaces of the rear pair of feet are sloped at an angle of between about 20° and about 60°.

27. A tray in accordance with claim 25 wherein the front surface of the rearmost rear shallow pocket and the front surface of the rearmost rear foot are sloped at an angle of about 45°, and the front surface of the frontmost rear shallow pocket and the front surface of the frontmost rear foot are sloped at an angle of about 55°.

28. A tray in accordance with claim 24 wherein front surfaces of the rear pair of deep pockets are sloped upwardly and toward a front of the tray and rear surfaces of the front pair of feet are sloped upwardly and toward the rear of the tray, the rear surfaces of the front pair of feet sliding along the front surfaces of the rear pair of deep pockets to facilitate removal of the feet from the deep pockets when stacked trays are blind unstacked from the second position.

29. A tray in accordance with claim 28 wherein the front surfaces of the rear pair of deep pockets and the rear surfaces of the front pair of feet are sloped at an angle of between about 20° and about 60°.

30. A tray in accordance with claim 28 wherein the front surface of the rearmost rear deep pocket and the rear surface of the frontmost front foot are sloped at an angle of about 45°, and the front surface of the frontmost rear deep pocket and the rear surface of the rearmost front foot are sloped at an angle of about 55°.

31. A tray in accordance with claim 22 further comprising central handles formed as apertures in a central portion of each end wall, each central handle having a generally flat top surface, a front surface sloping upwardly and toward a rear of the tray, and a rear surface sloping upwardly and toward a front of the tray, to facilitate stacking in the first, second and third positions and blind stacking and unstacking in the first and second positions.

32. A tray in accordance with claim 22 further comprising front handles formed as apertures in each end wall proximate a front edge thereof, each front handle having a front surface sloping upwardly and toward a back of the tray to facilitate blind stacking and unstacking in the first position.

33. A tray in accordance with claim 22 further comprising rear handles formed as apertures in each end wall proximate a rear edge thereof, each rear handle having a rear surface sloping upwardly and toward a front of the tray to facilitate blind stacking and unstacking in the second position.

34. A tray in accordance with claim 22 further comprising ribs formed on the exterior surfaces of the end walls, the ribs forming a pattern on each end wall distinct from the pattern on the other end wall to provide a visual indication of the orientation of the tray.

35. A multi level bakery tray comprising in combination:

a generally rectangular bottom;

opposed side walls and opposed end walls extending upwardly from the bottom, the tray being stacked with a like tray in a like orientation in a first position, in a second position when rotated 180° about its vertical axis, and in a third position when rotated 90° about its vertical axis;

a plurality of shallow pockets formed along upper edges of the end walls to receive the feet of a stacked tray when trays are stacked in the first position, a front surface of at least one shallow pocket being sloped upwardly and toward a front of the tray;

a plurality of deep pockets formed along upper edges of the end walls to receive the feet of a stacked tray when trays are stacked in the second position, a front surface of at least one deep pocket being sloped upwardly toward a front of the tray; and a plurality of feet formed along lower edges of the end walls, a majority of a front surface of at least one of the feet being sloped upwardly and toward a front of the tray to slide along the front surface of at least one shallow pocket and facilitate removal of the feet from the shallow pockets when stacked trays are blind unstacked from the first position, a majority of a rear surface of at least one of the feet being sloped upwardly and toward a back of the tray to slide along the front surface of at least one deep pocket and facilitate removal of the feet from the deep pockets when stacked trays are blind unstacked from the second position.

36. A tray in accordance with claim 35 wherein the plurality of shallow pockets comprise a front pair and a rear pair of shallow pockets, the plurality of deep pockets comprise a front pair and a rear pair of deep pockets, and the plurality of feet comprise a front pair and a rear pair of feet, front surfaces of the rear pair of shallow pockets and front surfaces of the rear pair of feet being sloped upwardly and toward a front of the tray such that the front surfaces of the rear pair of feet slide along the front surfaces of the rear pair of shallow pockets to facilitate removal of the feet from the shallow pockets when stacked trays are blind unstacked from the first position, front surfaces of the rear pair of deep pockets being sloped upwardly toward a front of the tray and rear surfaces of the front pair of feet being sloped upwardly and toward a back of the tray such that the rear surfaces of the front pair of feet slide along the front surfaces of the rear pair of deep pockets to facilitate removal of the feet from the deep pockets when stacked trays are blind unstacked from the second position.

37. A tray in accordance with claim 36 wherein the front surfaces of the rear pair of shallow pockets, the front surfaces of the rear pair of deep pockets, the front surfaces of the rear pair of feet, and the rear surfaces of the front pair of feet are sloped at an angle of between about 20° and about 60°.

38. A tray in accordance with claim 36 wherein the front surface of the rearmost rear shallow pocket, the front surface of the rearmost rear foot, the front surface of the rearmost rear deep pocket and the rear surface of the frontmost front foot are sloped at an angle of about 45°, and the front surface of the frontmost rear shallow pocket, the front surface of the frontmost rear foot, the front surface of the frontmost rear deep pocket, and the rear surface of the rearmost front foot are sloped at an angle of about 55°.

39. A tray in accordance with claim 36 wherein the front pair of shallow pockets are disposed between the front pair of deep pockets and the rear pair of deep pockets are disposed between the rear pair of shallow pockets, the front pair of feet of another tray stacked in like orientation on the tray being received by the front shallow pockets and the rear pair of feet of the other tray being received by the rear shallow pockets, the front pair of feet of the other tray being received by the rear pair of deep pockets and the rear pair of feet of the other tray being received by the front pair of deep pockets when the other tray is oriented 180° and stacked on the tray in the second position.

* * * * *